US005933981A

United States Patent [19]

Meschenmoser

[11] Patent Number: 5,933,981

[45] Date of Patent: Aug. 10, 1999

[54] DEVICE AND METHOD FOR STABILIZING A CONTINUOUS PAPER WEB IN A PAPER-MAKING MACHINE IN THE VICINITY OF A ROLL

[75] Inventor: Andreas Meschenmoser, Horgenzell, Germany

[73] Assignee: Voith Sulzer Papiermaschinen Gesellschaft mbH, Germany

[21] Appl. No.: 08/985,837

[22] Filed: Dec. 5, 1997

Related U.S. Application Data

[63] Continuation-in-part of application No. PCT/EP97/01604, Mar. 29, 1997.

[30] Foreign Application Priority Data

Apr. 6, 1996 [DE] Germany ..... 196 13 939

[51] Int. Cl.[6] ..... D21F 5/00; F26B 11/02

[52] U.S. Cl. ..... 34/456; 34/457; 34/114; 34/116; 34/119; 34/122; 34/125

[58] Field of Search ..... 34/454, 455, 456, 34/457, 458, 114, 115, 116, 117, 119, 122, 125; 162/193, 205, 358.1, 358.9

[56] References Cited

U.S. PATENT DOCUMENTS 4,628,618 12/1986 Virta et al.
4,692,215 9/1987 Kerttula .
4,893,741 1/1990 Heinzmann ..... 226/196
5,238,525 8/1993 Kraft .
5,438,765 8/1995 Tyrmi et al. ..... 34/456
5,509,215 4/1996 Koirnanen et al. ..... 34/117
5,515,619 5/1996 Kahl et al. ..... 34/114
5,560,123 10/1996 Eskelinen ..... 34/414
5,689,897 11/1997 Schiel ..... 34/122 X

FOREIGN PATENT DOCUMENTS 392808 6/1991 Austria .

*Primary Examiner*—Henry Bennett
*Assistant Examiner*—Steve Gravini
*Attorney, Agent, or Firm*—Ostrolenk, Faber, Gerb & Soffen, LLP

[57] ABSTRACT

In the device disclosed, a paper web is carried on a belt and stabilized by an underpressure produced by a box opposite the roll, the paper web being sucked by the underpressure against the belt. Located in the box, immediately following the underpressure zone, may be a pressure zone which assists to transfer the paper web to the roll. In an alternative embodiment, a fan can be avoided. Instead the air entrained by the rapidly running belt is deflected by a wedge-shaped deflector and passed over a slit to generate an underpressure inside the box.

10 Claims, 7 Drawing Sheets

DEVICE AND METHOD FOR STABILIZING A CONTINUOUS PAPER WEB IN A PAPER-MAKING MACHINE IN THE VICINITY OF A ROLL

RELATED APPLICATIONS

This is a continuation-in-part application of international patent application PCT/EP97/01604, filed Mar. 29, 1997, which claims priority of German patent application 196 13 939.2 and which is fully incorporated by reference.

BACKGROUND OF THE INVENTION

The present invention relates to a device for stabilizing a continuous paper web in a paper-making machine in the vicinity of a roll, to which the paper web is carried on a belt, comprising a box that is located upstream of the roll and extends along the side of the belt opposite the paper web, whose inside opens toward the belt and in which an underpressure is generated for sucking the paper web against the belt.

The present invention further relates to a method for stabilizing a paper web in a paper-making machine in the vicinity of a roll, to which the paper web is carried on a belt, wherein an underpressure is generated along the belt for sucking the paper web against the belt.

A device and a method of this kind for stabilizing a paper web are generally known (DE-A-44 02 105, DE-A-35 04 820).

In the case of high web running speeds, in particular when making paper grades of low basis weights, there is a risk of blisters forming as the paper web is transferred from a belt to a roll. This is so because the air necessarily entrained by the rapidly running paper web will be squeezed off in the nip between the belt, for example a felt, and the roll so that it has to escape laterally. If no additional counter-measures are taken this then results in a blister forming between the paper web and the belt before the point of entry into the nip (point of contact between the belt and the roll). The air enclosed in the blister must escape via the lateral edges of the paper web. The formation of such blisters is of course undesirable as it may lead to operational trouble and impair the paper quality.

The before mentioned DE-A-35 04 820 proposes for this purpose to generate an underpressure in the area preceding the transfer of the paper web to the roll, so as to suck the paper web against the belt in order to counteract the formation of blisters.

Further, it has been known from the before-mentioned DE-A-44 02 105 to expose a press felt, before its entry into the nip, to an underpressure over a first area of its path and to the action of steam over a following area, in order to de-water the press felt and, thus, to increase the dry content. In addition, the underpressure so produced counteracts the formation of blisters.

However, the known devices and methods are relatively complex and not easy to use in certain areas of a paper-making machine, i.e. such as press sections on the one hand and drying sections on the other hand.

SUMMARY OF THE INVENTION

It is an object of the present invention to provide a device and a method for stabilizing a paper web in the vicinity of a roll, which safely prevent the formation of blisters even in the case of rapidly running paper webs with low basis weights and which permit safe guiding of the web in the different areas of a paper-making machine to be ensured in an inexpensive way.

It is a further object of the invention to provide a device and a method which permit safe transfer of the paper web from one roll to another roll in a wet section, in particular in a wire section or in a press section of a paper-making machine, even at very high running speeds.

These and other objects are achieved in a device of the before-mentioned kind by the fact that a deflector surface is provided on the side of the box opposite the paper web, through which the air entrained by the belt is deflected to the outside and which communicates via a slit with the inner space of the box, which latter is open toward the belt.

The object of the invention is thus perfectly achieved.

According to the invention, the air entrained by the paper web and/or the belt is directly used to generate the underpressure within the box. This is achieved according to the invention by the fact that the deflector surface is used for deflecting the entrained air and passing it over a slit so as to produce an underpressure in the box. Thus, the underpressure needed to prevent blisters from forming is produced in the box, according to the invention, in a particularly simple way, without any need for a fan. Due to the particularly simple structure the device according to the invention can be used at numerous points of a paper-making machine, for example for transferring a paper web from a press felt to a guide roll or a suction guide roll and/or to a belt running about such a roll, or for transferring a paper web to a smooth press roll, a calander roll or to a drying cylinder in a drying section of a paper-making machine, or else for stabilizing the paper web as it is guided over a wire in the area of a wire drive roll.

According to an advantageous design of the invention, the deflector surface is curved toward the outside, relative to the belt, whereby a particularly efficient suction effect is achieved.

In a first embodiment of the invention, the suction slit is formed at the end of the deflector surface.

According to an alternative design of the invention it is, however, preferred to arrange the suction slit so that it interrupts the deflector surface, whereby an improved suction effect is achieved. It is especially advantageous in this connection if the suction slit is placed at the beginning of the deflector surface, as the air entrained by the belt has its highest speed in this area so that an especially high underpressure can be generated above the suction slit at this point.

According to a further embodiment of the invention, the paper web is transferred to the roll, while the belt is guided over a second roll.

With this design, the device according to the invention is employed with particular advantage in the area of a nip where the paper web is transferred from the belt to a first roll, with the effect that any formation of blisters, which is particularly critical in this area, is avoided by the device according to the invention in an especially simple and inexpensive way.

According to a further development of the invention, the inner space of the box is sealed off against the second roll.

One thereby achieves careful sealing between the deflector surface and the guide roll so that any pressure losses are minimized in order to ensure optimum effectiveness of the underpressure inside the box.

Alternatively, the object of the invention is achieved, in a device of the before-mentioned kind, by the fact that the box comprises a first and a second zone, the first zone being configured as an underpressure zone, for sucking the paper web against the belt, and the second zone being arranged downstream of the first zone and being designed as a pressure zone.

Although the first alternative of the invention is absolutely sufficient for most applications, this second alternative permits the paper web to be influenced very purposefully in order to avoid any formation of blisters, while at the same time the pressure zone that follows the underpressure zone facilitates the transfer of the paper web to the roll, making the transfer to the roll particularly safe. Thus, the paper web is sucked against the belt with sufficient safety in the zone of increased pressure before the roll, while at the same time the pressure zone provided downstream thereof makes the transfer to the roll particularly advantageous. This pressure-assisted transfer makes it possible in many cases to avoid the use of a suction roll and to permit instead the use of a simple roll. This leads to considerable cost savings.

According to a preferred further development of the invention, an air flow is generated in the box along the belt, essentially in the direction of movement of the belt, with a bottleneck being provided at the rear end of the box which acts to deflect the air flow toward the belt.

This arrangement provides a particularly simple way to guide the air inside the box.

Here again, a second roll may be arranged beside the roll, for guiding the belt, while the paper web is transferred from the belt to the first roll.

According to an advantageous further development of the invention, the box is sealed off from the belt by a sealing strip at its front delimiting surface, viewed in the direction of movement of the belt.

According to another advantageous further development of the invention, the box is sealed off by a sealing strip also against the second roll.

This feature provides an improved sealing effect between the box and the belt and/or the second roll.

As has been mentioned before, the first roll may be configured as guide roll or as suction guide roll, over which a press felt or a smooth felt is guided, and the second roll may be configured as a felt guide roll for guiding the belt from which the paper web is transferred to the other press felt, that latter belt being likewise configured as a press felt.

Further, the first roll may also be configured as press roll, as wire guide roll, as calander roll or as drying cylinder, to which the paper web is transferred from the belt.

With respect to the method of the invention, the object is further achieved, in a method of the before-mentioned kind, by the fact that an overpressure acting in the direction of the paper web is produced behind the underpressure zone, viewed in the direction of movement of the belt.

The invention thus on the one hand safely avoids any formation of blisters before the point of transfer of the paper web to the roll, while on the other hand the overpressure assists to transfer the paper web to the roll, with the advantages that have been described before.

In this context, an air flow, that is deflected in the direction of the belt, can be produced along the belt, substantially in the direction of movement of the belt.

It is thereby rendered possible to achieve a particularly simple air-guiding arrangement for the purpose of generating the underpressure and the overpressure.

According to an additional further development of that embodiment, air is blown off to the outside and in the direction of movement of the belt on both the guide and the drive ends of the belt.

This again has the effect to make the underpressure generation and/or the pressure generation in the different zones particularly efficient.

According to an alternative embodiment of the method according to the invention, the object of the invention is achieved, in a method of the before-mentioned kind, by the fact that the air flow entrained by the belt is deflected and utilized for generating an underpressure by means of which the paper web is sucked against the belt.

It is thus possible to produce the underpressure required to avoid the formation of blisters in an especially simple way, as the very air, that is entrained by the belt, is utilized thereby eliminating the need for a fan.

It is understood that the features mentioned above and those yet to be explained below can be used not only in the respective combinations indicated, but also in other combinations or in isolation, without leaving the context of the present invention.

SHORT DESCRIPTION OF THE DRAWINGS

Further features and advantages of the invention are evident from the description below of preferred exemplified embodiments, with reference to the drawings in which.

DETAILED DESCRIPTION OF THE PREFERRED EMBODIMENTS

Figure 1:
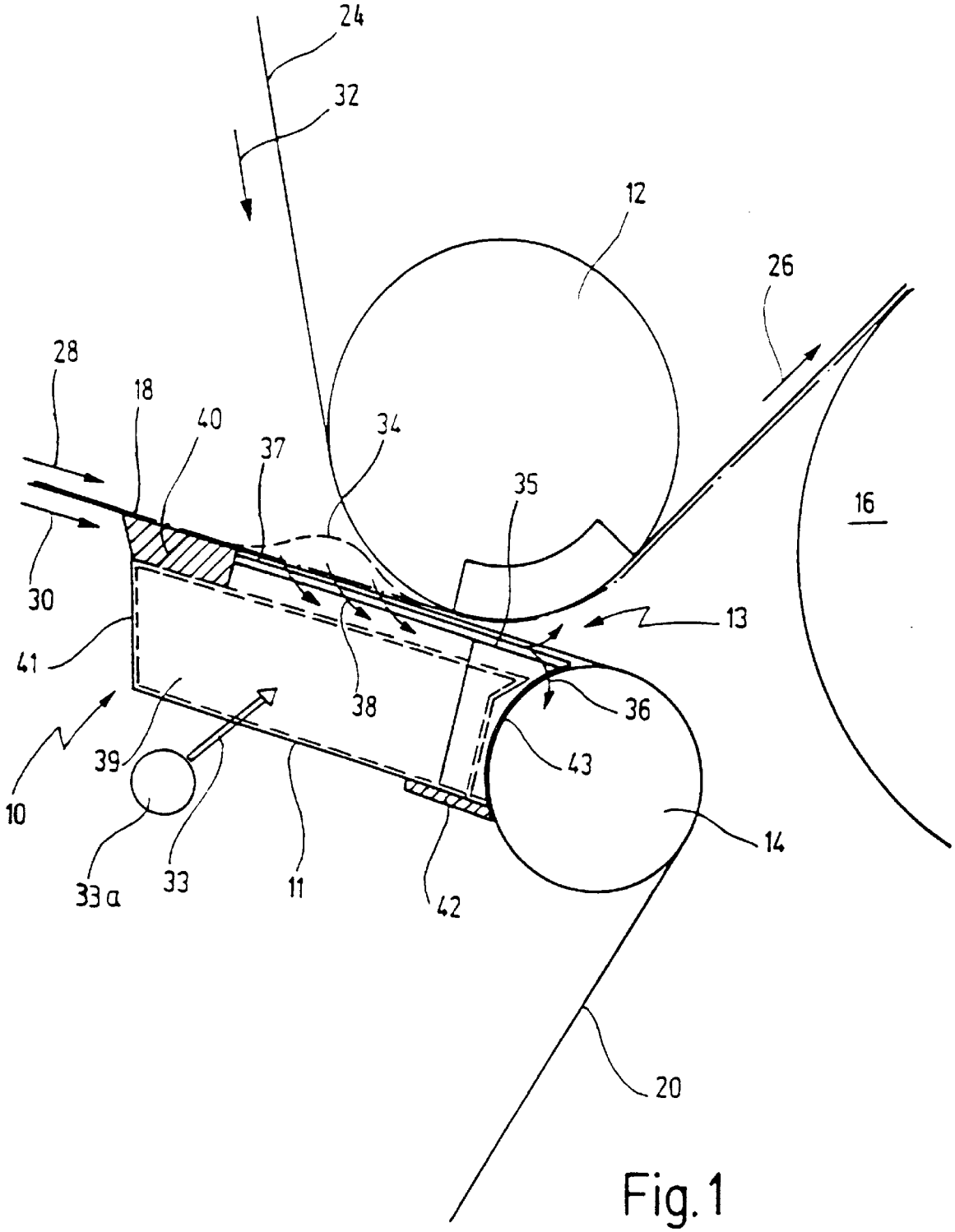
FIG. 1 shows a diagrammatic representation of a first embodiment of the invention, illustrating the area of a nip where the paper web is transferred from a belt to a first roll, while the belt is deflected by a second roll, with a compressed-air supply being provided for generating an underpressure.

FIG. 1 shows a detail of a press section of a paper-making machine, where a paper web 18, being guided on a belt 20 configured as a press felt, is transferred from the belt 20 to a press felt 24 which latter runs about a roll 12 configured as a suction roll, from where it is transferred to a downstream press roll 16.

The belt 20 is guided over, and deflected by, a felt guide roll 14 arranged a short way downstream of the suction roll 12. In the area upstream of the two rolls 12, 14, a device 10 according to the invention is arranged below the belt 20 for stabilizing the paper web 18, the device 10 extending substantially in parallel to the belt 20 and over the full width of the paper web 18.

As a result of the high running speeds, air layers are necessarily entrained by the belt 20 and the press felt 24 with the result that an air flow 28 acting in the direction of movement 26 is produced above the paper web 18, and a parallel air flow 30, also acting in the direction of movement 26, is produced below the belt 20. In addition, a corresponding air flow 32, acting in the direction of movement of the press felt 24, is also produced at the surface of the press felt 24 that is guided over the roll 12.

As the belt 20, with the paper web 18 carried thereon, contacts the roll 12 in the so-called felt nip 13, the air flows 28 and 32 are squeezed off at that line of contact. In addition, an air layer produced between the paper web 18 and the belt 20 by relaxation of the belt and/or re-humidification of the paper web, is also entrained and squeezed off at the felt nip. In particular in the case of high running speeds and low basis weights, the air dammed up causes the paper web 18 to bulge out or to form a blister, as illustrated by the broken line 34 in FIG. 1. This means that the paper web 18 is slightly lifted off the belt 20, on which it is guided, before the felt nip 13 and comes to "float" on the cushion formed by the air flow 28, with the effect that part of the air can escape from the blister 34 laterally via the edges of the paper web 18.

Such formation of blisters is of course extremely undesirable as it increases the risk of failure and as it may under certain circumstances impair the paper quality.

The device 10 according to the invention serves to prevent such formation of blisters.

The device 10 comprises a closed box 11 which is arranged below the belt 20 and which extends parallel to the belt 20 and ends shortly before the surface of roll 14, with an air gap 37 on the order of roughly 20 mm being maintained with respect to the lower side of belt 20. At its front delimiting surface 41, viewed in the direction of movement 26, the box 11 is sealed off from the belt 20, i.e. against the press felt, by a sealing strip 40 which extends transversely to the direction of movement 26. With respect to roll 14 the box 11 is delimited by a limiting surface 43 which extends parallel to the surface of roll 14. The box 11 is sealed against roll 14 at its lower side by a further sealing strip 42.

Along air gap 37, which is formed between the surface of box 11 and the lower side of belt 20, air is blown by a blower 33*a* into the interior of box 11, as indicated by arrow 33. The air emerges via an outblow slit 35 with respect to the guide side and to the drive side and possibly into the direction of movement 26 against felt leading roll 14, as indicated by arrows 36. This leads to an underpressure within box 11 below belt 20, and consequently any formation of blisters before the felt nip 13 is prevented and an air flow in the direction of arrows 38 through belt 20 is formed.

Figure 2:
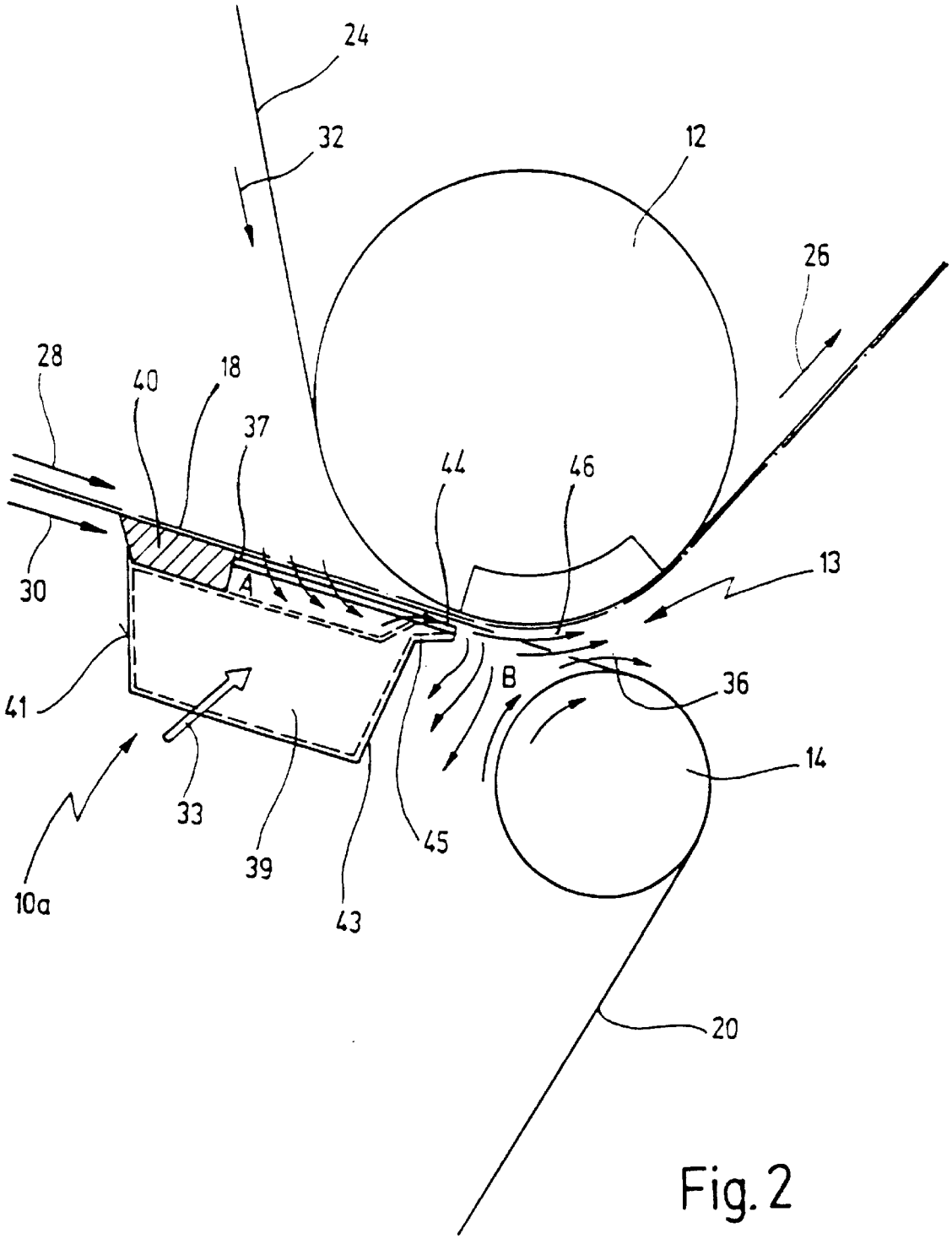
FIG. 2 shows a diagrammatic representation of a second embodiment of the invention, likewise comprising a compressed-air supply in the area of a nip.

A modification of the invention is shown in FIG. 2.

In this figure as well as in the following figures the same reference numerals are used for corresponding parts.

The device, indicated generally by reference numeral 10*a*, comprises a box 11, of roughly trapezoidal cross-section, that extends over the full width of the paper web and along the lower face of the belt 20, with an air gap 37 being maintained between the box and the lower surface of the belt 30. At its front delimiting surface 41, viewed in the direction of movement 26, the box 11 is again sealed off from the belt 20 by a sealing strip 40. However, in contrast to the design according to FIG. 1, the rear delimiting surface 43 of the box 11, facing the roll 14, is however arranged at a certain spacing from the surface of the roll 14 and is not sealed against the roll 14 by a seal. Consequently, there exists an air gap between the rear delimiting surface 43 of the box 11 and the surface of the roll 14. At the rear end of the box, facing the roll 14, the air gap 37 is narrowed by a bottleneck 44 with the result that the air flow is accelerated on its way through the bottleneck in the direction of arrows 46, and through the downstream zone B.

Air is blown off along the air gap 37 toward the drive end and toward the lead end and in the direction of movement 26 toward the roll 14, so that in the area below the belt 20 an air flow is produced from the underpressure zone A through the bottleneck 44 into the zone B, as indicated by arrows 46. In the zone B, following the bottleneck 44, between the box 11 and the roll 14, a zone of slight overpressure results since the air flowing in through the gap 44 dams up between the rear delimiting surface 43 of the box 11 and the roll 14 and escapes toward the bottom and at the same time through the belt 20 toward the top, as indicated by arrows 36, which assists to transfer the paper web 18 to the roll 12.

Figure 3:
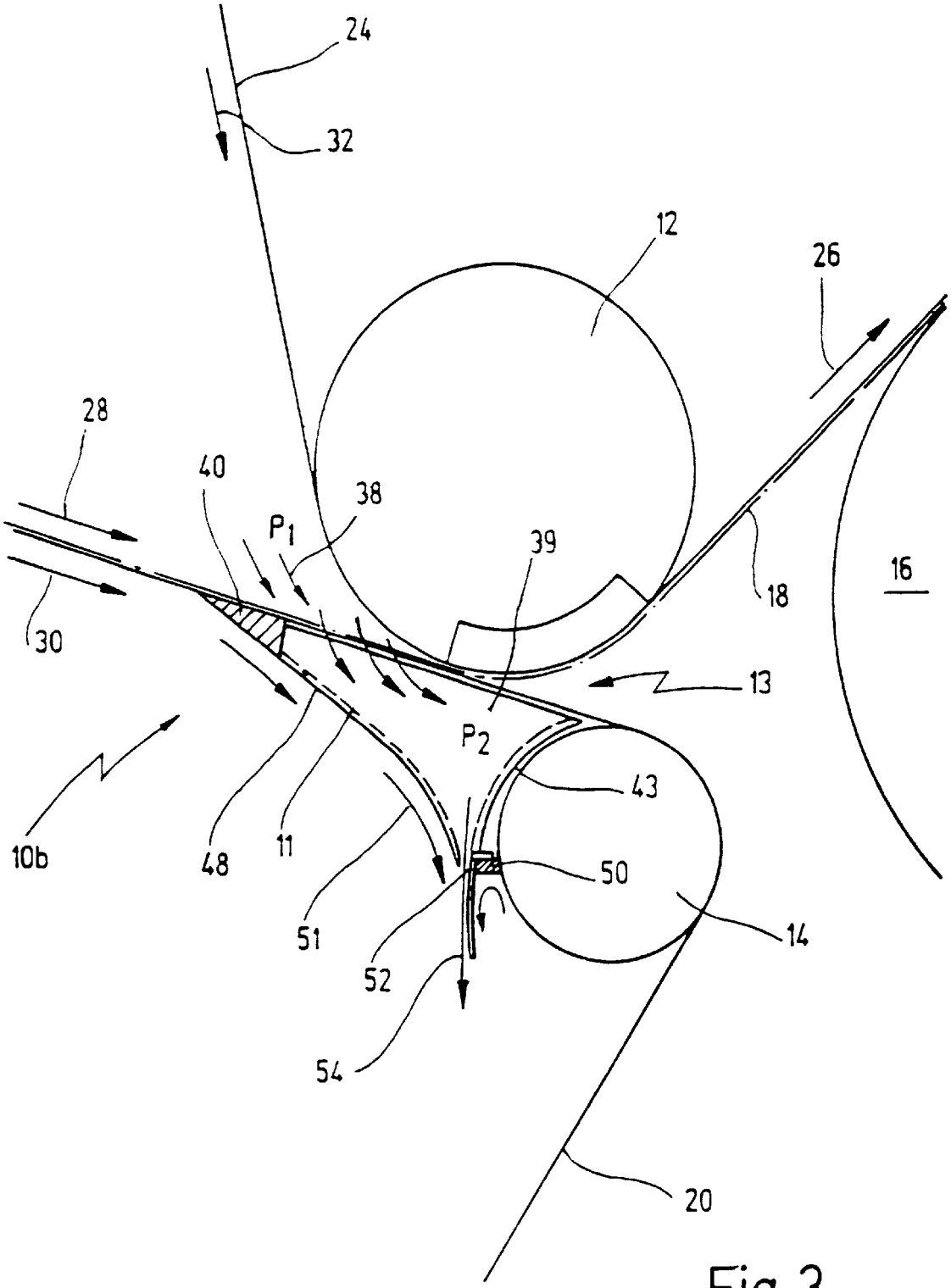
FIG. 3 shows a diagrammatic representation of a third embodiment of the invention, without a compressed-air supply in the area of a nip.

Another embodiment of the device according to the invention, somewhat simplified as compared with the embodiments described before, is illustrated in FIG. 3 and indicated generally by reference numeral 10*b*.

This device comprises again a box 11, extending below the belt 20, over the full width of the paper web and up to a short distance before the roll 14. At its front end, viewed in the direction of movement 26, the box 11 is sealed off against the belt 20 by a sealing strip 40.

In contrast to the embodiments described before, this embodiment does without the assistance of a fan; instead the air flow 30 at the lower surface of the belt 20 is used for producing an underpressure in the enclosed space between the box 11 and the belt 20. To this end, the air flow is deflected by a sealing strip 40, that extends over the full width of the paper web, from the bottom of the belt 20 in downward direction and along a curved deflector surface 48, as indicated by arrows. 51. On the bottom face of the box 11, there is provided a wall 50 that screens the roll 14 off against the air flow and that prevents any backflow of the air entrained by the roll 14. Thus, the air flow exiting toward the bottom, as indicated by 54, results in a diffuser effect that causes an underpressure to build up in a suction slit 52 formed between the lower end of the deflector surface 48 and the wall 50, so that a somewhat lower pressure, indicated by $P_2$ in FIG. 3, occurs in the enclosed space 39 of the box 11 defined by the bottom of the belt 20, the deflector surface 48 and the wall 14 and, at its end face, by the end sealing plates. Given the fact that a somewhat higher pressure, indicated by $P_1$ in FIG. 3, occurs in the area above the paper web 18, a pressure gradient $P_2$–$P_1$ results with the effect that air flows in the direction of arrows 38 through the belt 20 and in downward direction and escapes from the box 11 through the suction slit 52 in downward direction, as indicated by arrow 54.

At its lead and end faces, the box 11 is sealed off against the belt 20 and the roll 14 by respective end sealing plates, with a minimal gap.

All in all, it is possible in this way to avoid the formation of blisters before the felt nip 13, and this even without the additional assistance of a fan.

Figure 4:
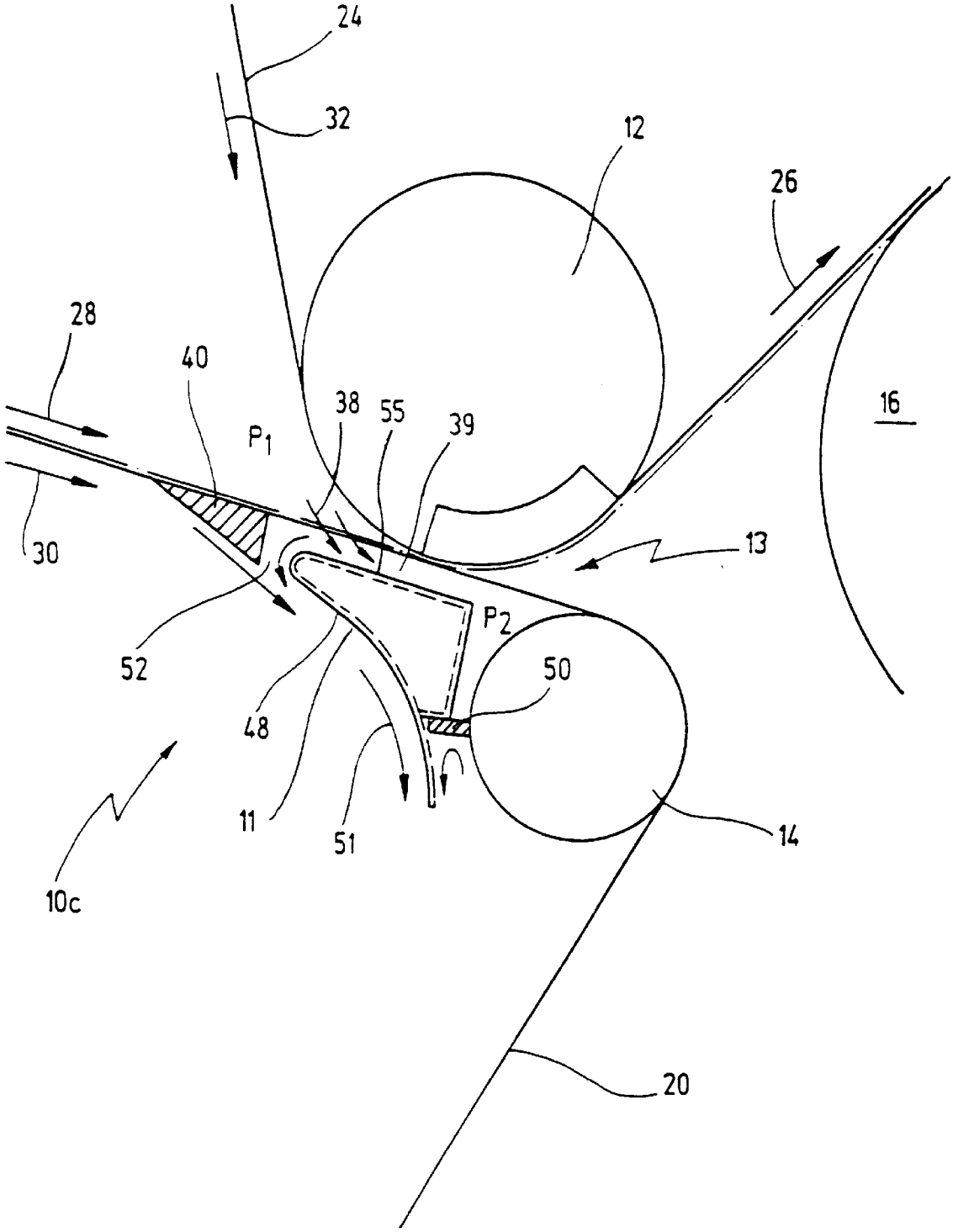
FIG. 4 shows a diagrammatic representation of a fourth embodiment of the invention, without a compressed-air supply in the area of a nip.

A variant of the embodiment described before with reference to FIG. 3 is illustrated with reference to FIG. 4. In the case of that device, which is indicated generally by reference numeral 10*c*, the air flow 30 is again deflected by the sealing strip 40 from the bottom surface of the belt 20 in downward direction and is further deflected in downward direction by the downwardly curved deflector surface 48 that extends over the full width of the paper web, in order to generate an underpressure in the box 11.

In contrast to the embodiment described before with reference to FIG. 3, the suction slit is in this case provided not at the end of the deflector surface 48, but rather at the beginning of the deflector surface 48, immediately behind the sealing strip 40, by which the box 11 is sealed at its front end, in the direction of movement 26, against the belt 20. The end of the inner space 39 of the box facing the second roll 14 is sealed off by a wall 50 against the second roll 14, which latter can be inclined relative to the roll 14. Again, the box 11 has its end sealed on the lead and drive sides.

This altogether ensures efficient sealing of the inner space 39 against the outside and against the second roll 14, while the arrangement of the suction slit 52 at the beginning of the deflector surface 48 leads to an especially good suction effect. The suction slit 52, extending from the deflector surface 48 to the inside of the box, terminates by a delimiting surface 55 in the inner space 49 of the box, that extends initially roughly in parallel to the belt 20, and then approximately at a right angle away from the belt 20 and in downward direction, being then sealed off at its lower end against the second roll 14 by a wall strip 52. The deflector surface 48 and the delimiting surface 55 create an enclosed volume of substantially triangular cross-section that reduces the inner space 39 of the box 11, thereby considerably increasing the effect of the underpressure in the inner space 39.

Thus, it is possible, even without an additional fan, to achieve a good underpressure effect in the inner space 39 of the box which avoids any formation of blisters and ensures safe guiding of the strip.

It goes without saying that such a device for stabilizing the paper web can be provided not only in the area of a press section of a paper-making machine, as has been illustrated above with reference to FIGS. 1 to 4. Instead, such a device can be used in all contexts where a paper web has to be transferred from a belt to a roll.

This will be explained in more detail with reference to FIGS. 5 to 8.

Figure 5:
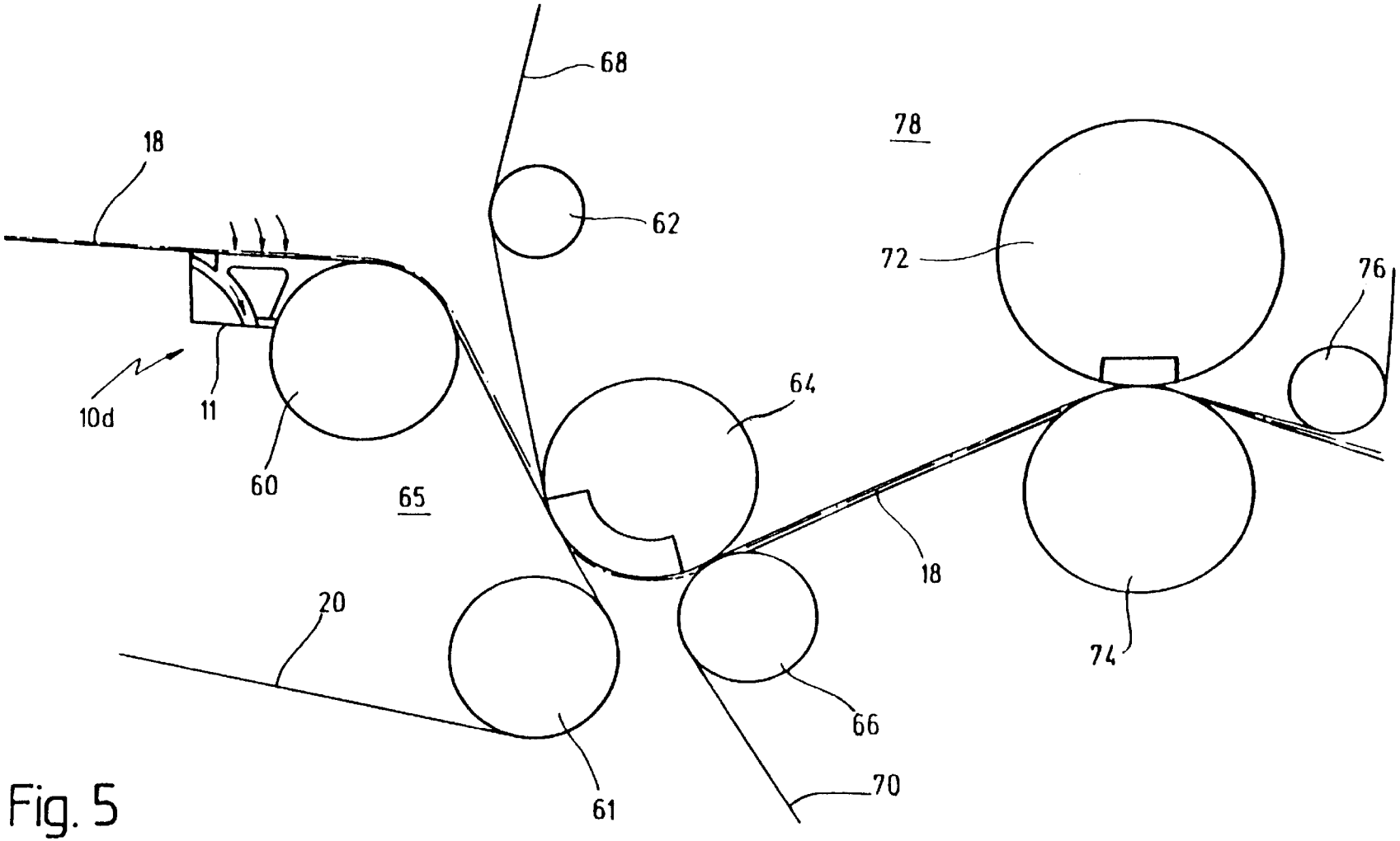
FIG. 5 shows a diagrammatic representation of a fifth embodiment of the invention, where the device according to the invention is arranged before a wire drive roll.

FIG. 5 shows a detail of a paper-making machine in the area of transfer from a wire section 65 to a downstream press section 78.

In the wire section 65, the paper web 18, carried on the belt 20 designed as wire, is guided over the wire drive rolls 60, 21. Upstream of the wire drive roll 60, there is provided a device 10*d* according to the invention, which may have the same configuration as that shown in FIG. 4. The box 11 acts to suck the paper web 18 against the belt 20 so that the wire drive roll 60, over which the wire is guided, need not be configured as a suction roll, which in turn results in corresponding cost savings. Thereafter, the paper web 18 is removed from the wire in a manner known as such, by means of a take-over roll 64 in the form of a wire roll, and is guided between an upper felt 68 and a lower felt 70 through a first press nip formed between a shoe press with an upper shoe press roll 72 and a lower back-up roll 74. The upper felt 68 runs in the known manner about a felt guide roll 62 and the take-over roll 64 trough the press nip and is deflected, downstream of the press nip, by a felt guide roll 76. A felt guide roll 66 guides the lower felt 70 to the paper web 18 at a point a short way downstream of the take-over roll 64.

Figure 6:
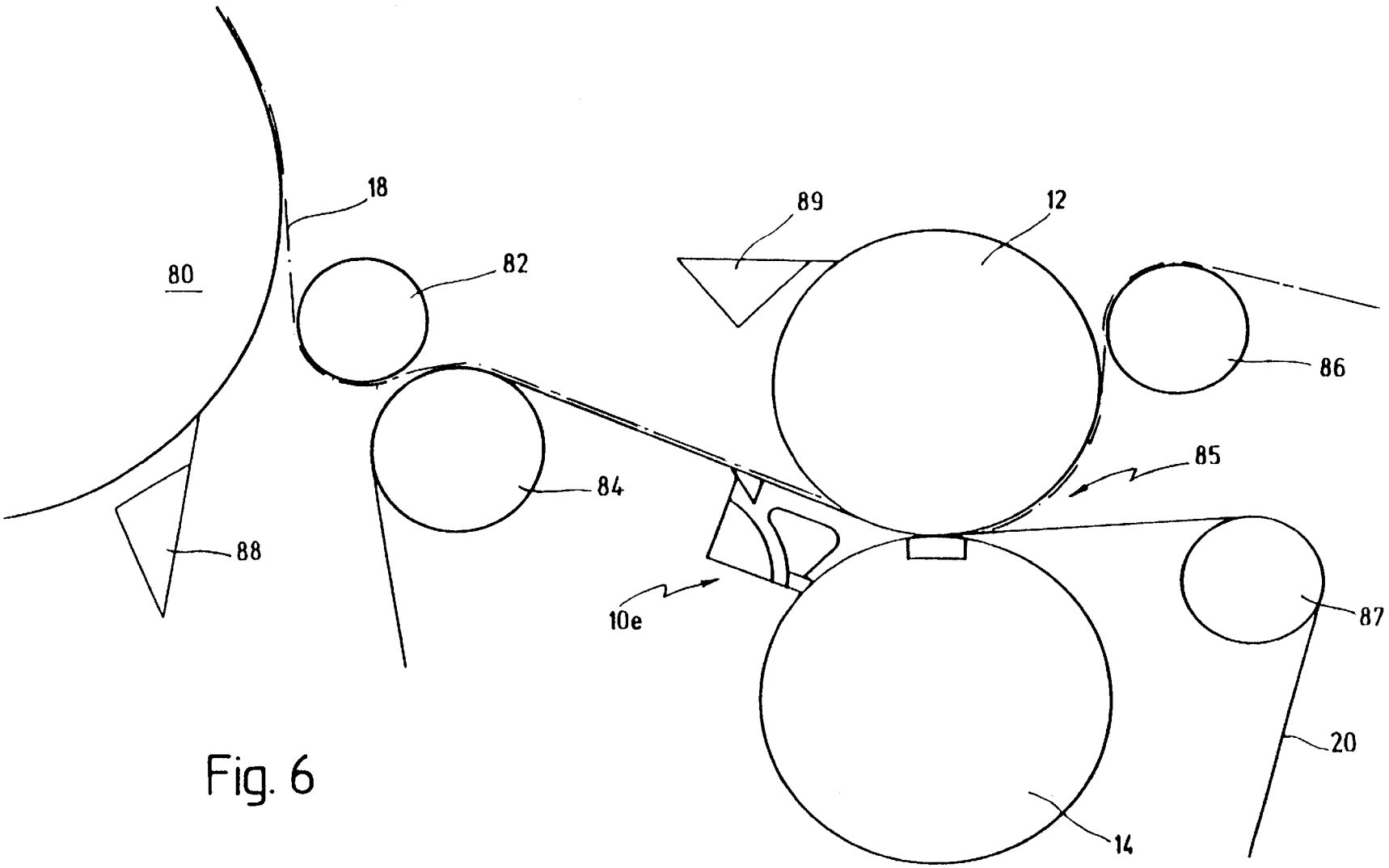
FIG. 6 shows a diagrammatic representation of a sixth embodiment of the invention, where the device according to the invention is arranged before the point of entry of the paper web into a press nip.

Another possible application of the invention is illustrated in FIG. 6. In this case, the device 10e according to the invention, the design of which may be identical to the device 10*c* according to FIG. 4, is arranged on the entry side of the paper web 18 into a press nip 85 that may be formed for example by a stand-alone shoe press 12, 14 with the shoe press roll arranged at the bottom.

The paper web 18 is taken over from a roll 80, which may be the central roll of the press section, by means of a take-over roll 82 and is then transferred to the belt 20, that is designed as lower felt and runs on felt guide rolls 84, 87. After having passed the press nip 85, the paper web 18 is taken off the roll 12 by a take-over roll 86 and is then transferred to a downstream drying section not shown in the drawing.

The roll 80 and the roll 12 are cleaned in the known manner by means of scrapers 88, 89.

Figure 7:
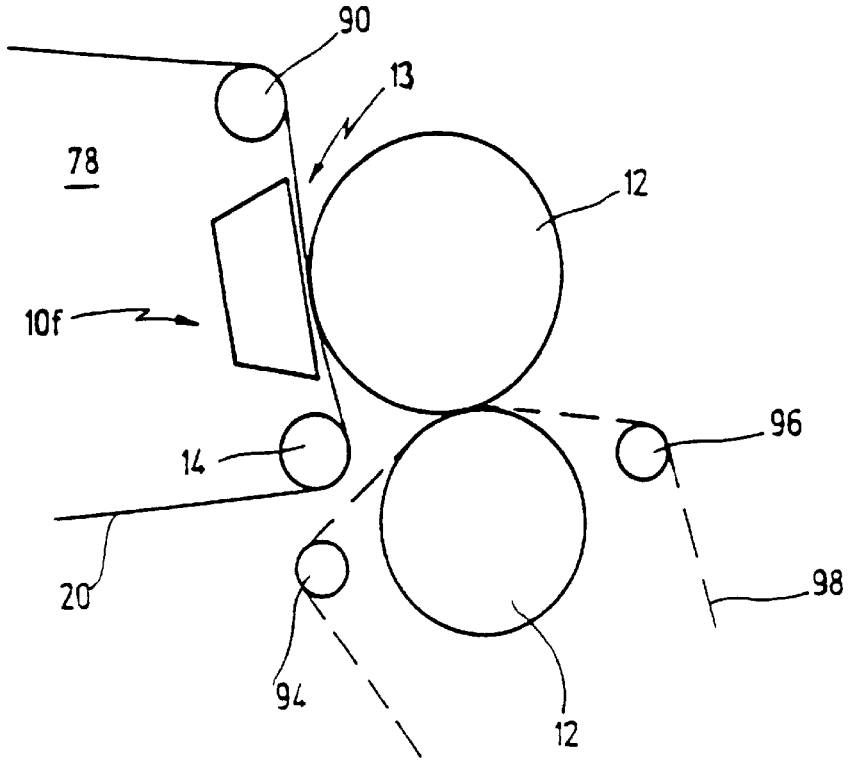
FIG. 7 shows a diagrammatic representation of another possible application of the invention, at the point of transfer to a smooth press roll.
Figure 8:
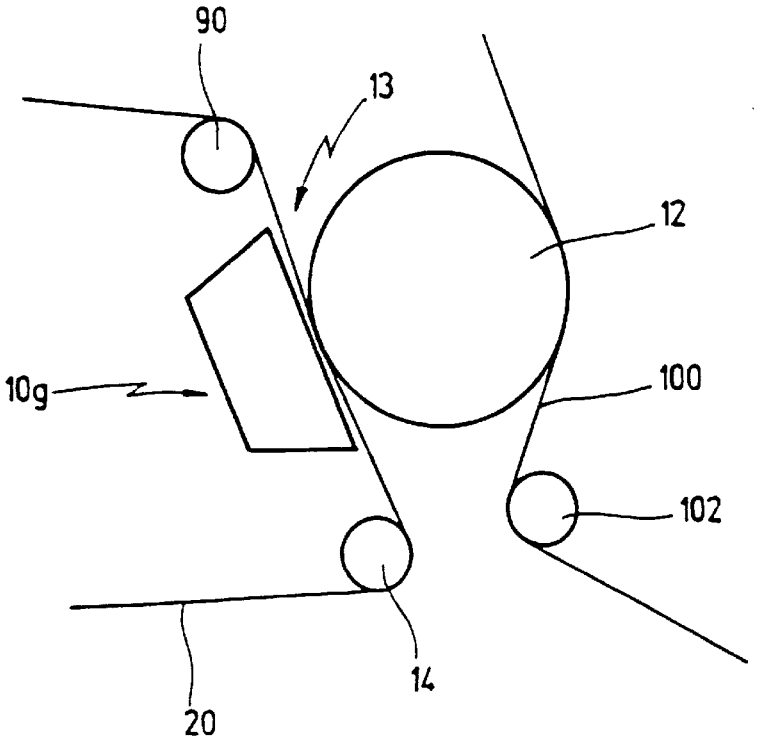
FIG. 8 shows a diagrammatic representation of another possible application of the invention, at the point of transfer of the paper web to a drying cylinder.

Other generally possible applications of the invention are illustrated in FIGS. 7 and 8.

In FIG. 7, a roll 12 and a back-up roll 92 form together a press nip through which a press felt 98, if necessary, may be guided via felt guide rolls 94, 96.

A paper web is guided on the belt 20, configured as a press felt, over a front felt guide roll 90 and a rear felt guide roll 14 and is transferred from the belt 20 to the roll 12, which latter is configured as a smooth press roll. In the area of the felt nip 13, there is again provided a device according to the invention, which is indicated generally by reference numeral 10*f* and can be designed according to FIG. 1, FIG. 2, FIG. 3 or FIG. 4, as necessary under the particular circumstances. In any case, an underpressure is generated in the area of the felt nip 13, which acts to prevent any formation of blisters. If the device 10*f* is equipped with an active fan assist feature, a certain overpressure is additionally produced at the rear end of the device 10*f*, viewed in the running direction of the strip, to assist the transfer of the paper web to the roll 12.

The roll 12 may of course also consist of a roll of any other kind, such as a calander roll or a drying cylinder.

FIG. 8 illustrates the transfer of a paper web to a roll 12 designed as drying cylinder. In this case, the paper web is transferred from the belt 20 to a roll 12 of a drying section 104, which roll is in this case designed as a drying cylinder, and is then guided via a drying wire 100 guided over the roll 12 via a deflection roll 102.

What is claimed is:

1. A device for stabilizing a continuous paper web in a paper-making machine in the vicinity of a first roll, to which the paper web is carried on an air-permeable belt which is guided over a second roll, said device comprising:

a box arranged upstream of the roll and extending along the belt opposite the paper web, said box enclosing an inner space that is at least partially open toward the belt, said inner space comprising a first zone adjacent said belt, and a second zone which is located adjacent said first zone downstream thereof;

a blower means for generating an air flow within said box effecting an underpressure within said first zone and an overpressure within said second zone, wherein said paper web is sucked against the belt within said first zone; and a blowing slot arranged in the second zone opening to the first roll such that said paper web is transferred from said belt onto said first roll within said second zone by air blown out of said blowing slot towards said first roll.

2. The device of claim 1, which further comprises a bottleneck which is provided at a downstream end of said box, said bottleneck acting to deflect an air flow, which is generated within the box along the belt essentially in a direction of movement of the belt, toward the belt.

3. The device of claim 1, which further comprises a sealing strip for sealing off said inner space from said belt at an upstream end of said box.

4. The device of claim 3, which further comprises a sealing strip for sealing said inner space against said second roll.

5. The device of claim 1, wherein said first roll is configured as guide roll, over which a second belt is guided, and wherein said paper web is transferred from said air-permeable belt to said second belt.

6. The device of claim 1, wherein said first roll is configured as one of a press roll, a calander roll and a drying cylinder, to which said paper web is transferred from said air-permeable belt.

7. The device of claim 1, wherein said air-permeable belt is configured as a wire which is guided over said first roll.

8. A method for stabilizing a paper web in a paper-making machine in the vicinity of a roll to which the paper web is transferred from an air-permeable belt, which comprises:

generating an underpressure along the belt for sucking the paper web against the belt;

generating an overpressure acting in the direction of the belt downstream of the underpressure zone, viewed in the direction of movement of the belt; and blowing air through said air-permeable belt towards said roll for transferring said paper web from said air-permeable belt onto said roll.

9. The method of claim 8, wherein an air flow is produced along the belt, substantially in the direction of movement of the belt, and is deflected in the direction of the belt.

10. The method according of claim 9, wherein air is blown off, assisted by a fan, to the outside and in the direction of movement of the belt on both the guide and the drive ends of the belt in order to produce an underpressure between the belt and the paper web.

* * * * *